US010174961B2

(12) United States Patent
Varley et al.

(10) Patent No.: US 10,174,961 B2
(45) Date of Patent: Jan. 8, 2019

(54) OPEN FUME CAPTURE AND EXHAUST VENTILATED WORK STATION

(71) Applicant: Harley Ellis Devereaux Corporation, Southfield, MI (US)

(72) Inventors: John O. Varley, Kenosha, WI (US); Mark C. Hartmann, Artlinton Heights, IL (US)

( * ) Notice: Subject to any disclaimer, the term of this patent is extended or adjusted under 35 U.S.C. 154(b) by 175 days.

(21) Appl. No.: 14/972,011

(22) Filed: Dec. 16, 2015

(65) Prior Publication Data

US 2017/0173647 A1 Jun. 22, 2017

(51) Int. Cl.

| | |
|---|---|
| ***B08B 15/02*** | (2006.01) |
| ***F24F 7/00*** | (2006.01) |
| ***B08B 15/00*** | (2006.01) |
| ***B25H 1/20*** | (2006.01) |
| ***F24F 7/06*** | (2006.01) |
| ***F24F 13/06*** | (2006.01) |

(52) U.S. Cl.

CPC ..... *F24F 7/00* (2013.01); *B08B 15/00* (2013.01); *B25H 1/20* (2013.01); *F24F 7/065* (2013.01); *F24F 13/0604* (2013.01); *B08B 2215/003* (2013.01); *F24F 2007/001* (2013.01)

(58) Field of Classification Search

CPC ..... B08B 15/002; B08B 15/02; B08B 15/023; B08B 15/00; B08B 2215/003; B08B 2215/006; F24F 2007/001; F24F 7/007; F24F 7/04; F24F 3/1607; F47B 2037/005

USPC ..... 108/50.13, 50.18; 454/49, 66, 228, 63, 454/64

See application file for complete search history.

(56) References Cited

U.S. PATENT DOCUMENTS 3,496,704 A * 2/1970 Bandlow ..... F24C 15/2092 126/299 D 4,089,916 A 5/1978 Hay (Continued)

FOREIGN PATENT DOCUMENTS

JP 63267854 A * 11/1988

OTHER PUBLICATIONS

S. I. Watson, J. R. Cain, H. Cowie and J. W. Cherrie, "Development of a Push-pull Ventilation System to Control Solder Fume", The Annals of Occupational Hygiene, vol. 45, No. 8, pp. 669-676, 2001.

*Primary Examiner* — Helena Kosanovic
*Assistant Examiner* — Ko-Wei Lin
(74) *Attorney, Agent, or Firm* — Holland & Knight LLP

(57) ABSTRACT

An open fume capture and exhaust work station for a laboratory classroom having an air exhaust system that provides unobstructed sight lines for students at the station of the other students and of a classroom instructor. The work station includes an upper table surface providing a plurality of individual work surfaces, a fume extractor extending upwardly from a middle portion of the table surface to an elevation below the student sight lines, a pair of elongated air outlet openings adjacent to opposed sides of the table for directing fan generated opposed airflows to the extractor which defines opposed upstanding air inlet faces and communicates those faces with the air exhaust system creating a pressure drop within the extractor that captures the opposed inwardly airflows and pull the airflows over the individual work surfaces and into said extractor, capturing and removing emissions from spills and experiments on those work surfaces.

12 Claims, 10 Drawing Sheets

(56) References Cited

U.S. PATENT DOCUMENTS

| | | | | |
|---|---|---|---|---|
| 4,409,889 | A | 10/1983 | Burleson | |
| 4,446,849 | A * | 5/1984 | McFarland | F24C 15/2042 126/299 R |
| 4,475,534 | A | 10/1984 | Moriarty | |
| 4,598,691 | A * | 7/1986 | Herrelko | F24C 15/2007 126/19 R |
| 6,085,665 | A | 7/2000 | Smith et al. | |
| 6,095,918 | A | 8/2000 | Arroyo et al. | |
| 6,336,691 | B1 * | 1/2002 | Maroney | H05K 7/20127 312/213 |
| 6,428,408 | B1 | 8/2002 | Bell et al. | |
| 7,243,506 | B2 | 7/2007 | Spillner | |
| 9,056,339 | B2 | 6/2015 | Smith et al. | |
| 2013/0074261 | A1 | 3/2013 | Hallman | |

* cited by examiner

OPEN FUME CAPTURE AND EXHAUST VENTILATED WORK STATION

BACKGROUND OF THE INVENTION

The present invention relates to a multi-student teaching laboratory station particularly adapted for university chemistry classes. For use in both classroom and laboratory environments, such a station should provide the students with a flat work surface, an unobstructed view of other students and the instructor, conventional laboratory features for conducting chemical experiments such as sinks, faucets, gas outlets and electrical connections and an inventive fume capture and exhaust system over the work surface with sufficient height and width for effectively capturing and removing fugitive and other noxious emissions resulting from spills or the experiments conducted on the table.

While a variety of work stations have been developed for capturing, containing and exhausting fumes and vapors generated by the work being conducted thereon, such stations typically employ a form of enclosure, such as a chemical fume hood, that encloses the work space to effect the capture and exhaust. Such enclosed stations, even if made of transparent material, would not be well suited for classroom or demonstration applications as the students' view of the instructor would be obstructed by these structures. An example of such a work station is found in U.S. Pat. No. 6,428,408. Other clean air work stations have been developed in which air is drawn inwardly under a table by a fan, redirected along a vertical curvilinear path and back over the flat work surface of the table. While such a design can provide airflow both at and above the table surface level to better capture the emissions from both spills and the open ends of beakers and flasks sitting on heating units on the work surface, the panels for redirecting the airflow again are view obstructing so that such apparatus does not provide the pedagogical requirements of Applicant's air station and may not provide a means for exhausting the contaminated flow. See, for example, U.S. Pat. No. 6,095,918.

Another system of which Applicant is aware that was developed to provide ventilating air to control solder fume and which is not view obstructing is disclosed in an article entitled *Development of a Push-pull Ventilation System to Control Solder Fume,* authored by S. I. Watson, J. R. Cain, H. Cowie and J. W. Cherrie, published in 2001 by *The Annals of Occupational Hygiene,* Vol. 45, No. 8 pp. 669-676. While the solder fume control system disclosed therein would not obstruct the student view, its ventilating airflow was limited to the surface of the work station and thus would not capture fumes above the table surface that would contaminate the air proximate the students' faces.

The air station of the present invention allows the students to perform experiments in a teaching lab setting without obstructing student sight lines to the instructor in the laboratory while providing a highly efficient "push-pull" ventilation system to capture fumes from the surface of the station and from lab vessels resting thereon and exhaust those fumes out of the lab thereby minimizing the exposure of the students to the fumes and odors generated from the classroom experiments.

SUMMARY OF THE PRESENT INVENTION

Briefly, the present invention is directed to a work station that allows a plurality of students to perform chemical experiments in a teaching laboratory setting, provides flat work surfaces for the students at the station and an efficient airflow system adjacent to and over the work surfaces for effectively capturing and removing fugitive and other noxious emissions resulting from spills on the work surfaces and fumes emitted from the open ends of beakers, flasks and other containers used in experiments conducted on the station, all without obstructing student sight lines to the instructor.

Preferably, the flat work surface accommodates up to four students comprising two pair of lab partners with each pair positioned on opposed sides of the work surface. The airflow system comprises an efficient push-pull system having a relatively low profile fume extractor in the middle of the work surface which is under suction from an exhaust system and defines opposed upstanding air inlet faces. At least one air supply fan located within a plenum below the work surface generates a relatively wide push of air toward opposed upstanding faces of the extractor from a pair of elongated air outlet openings substantially adjacent to and extending along opposed perimeter portions of the work surface. The resulting airflow and emissions captured thereby are exhausted from the station through the interior of the fume extractor via the exhaust system.

The elevation of the fume extractor while insufficient to obstruct student sight lines to the instructor, is sufficient so as to cooperate with the air outlet openings to create opposed airflows that expand upwardly as they flow inwardly over the work surface from opposed air outlets substantially adjacent to the work surface to and through the opposed upstanding air inlet faces of the fume extractor at elevations sufficient to effect the capture and containment of fugitive emissions that not only result from spills on the work surface but also emissions that emanate from the open upper ends of beakers and other containers on the work station.

Preferably, in the work station of the present invention, the opposed elongated air outlet openings substantially adjacent to the work surface are curvilinear and each define substantially equal radii of curvature such that the airflow vectors created at the air outlet openings at the opposed edges of the work surface exit those openings normal to the curved lines of the openings and to the opposed faces of the fume extractor, thereby reducing turbulence and the escape of airflow from the pull hood.

DETAILED DESCRIPTION OF THE PREFERRED EMBODIMENTS

Figure 2:
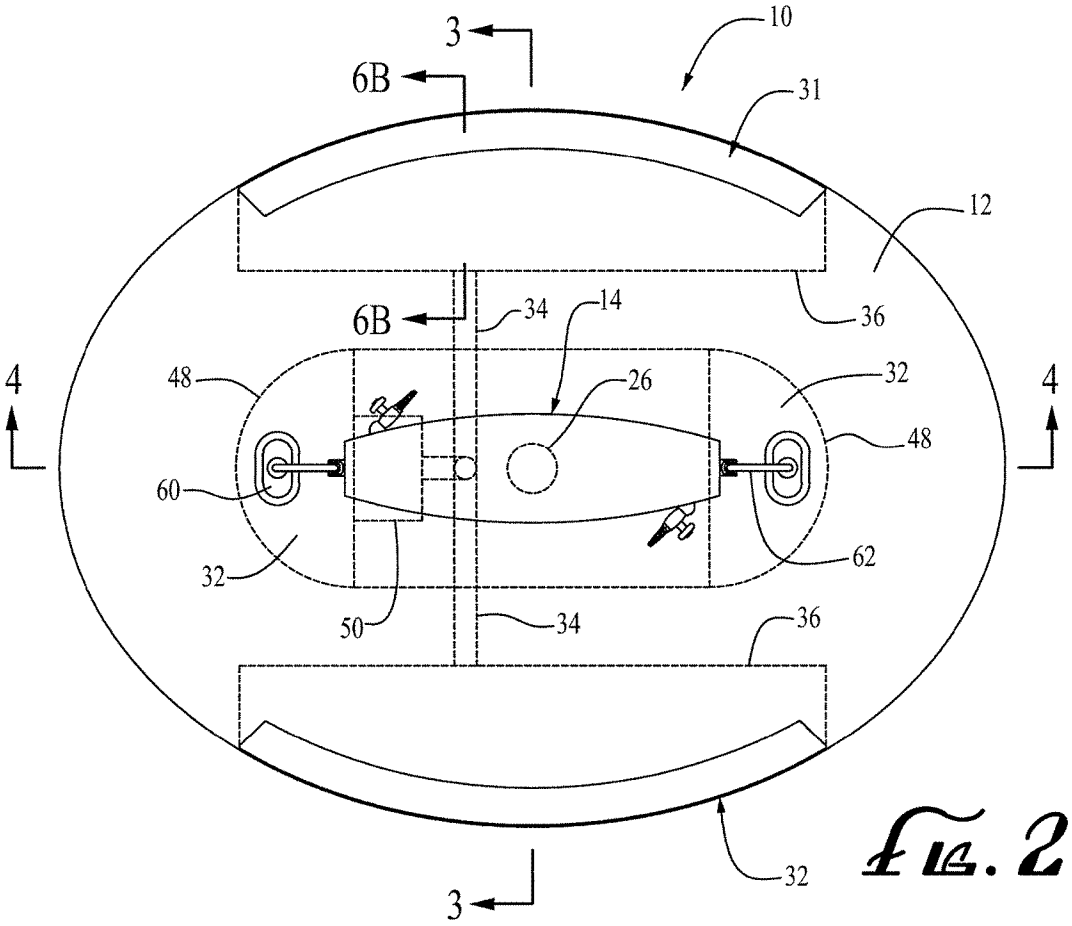
FIG. 2 is a top plan view of the work station shown in FIG. 1.
Figure 8:
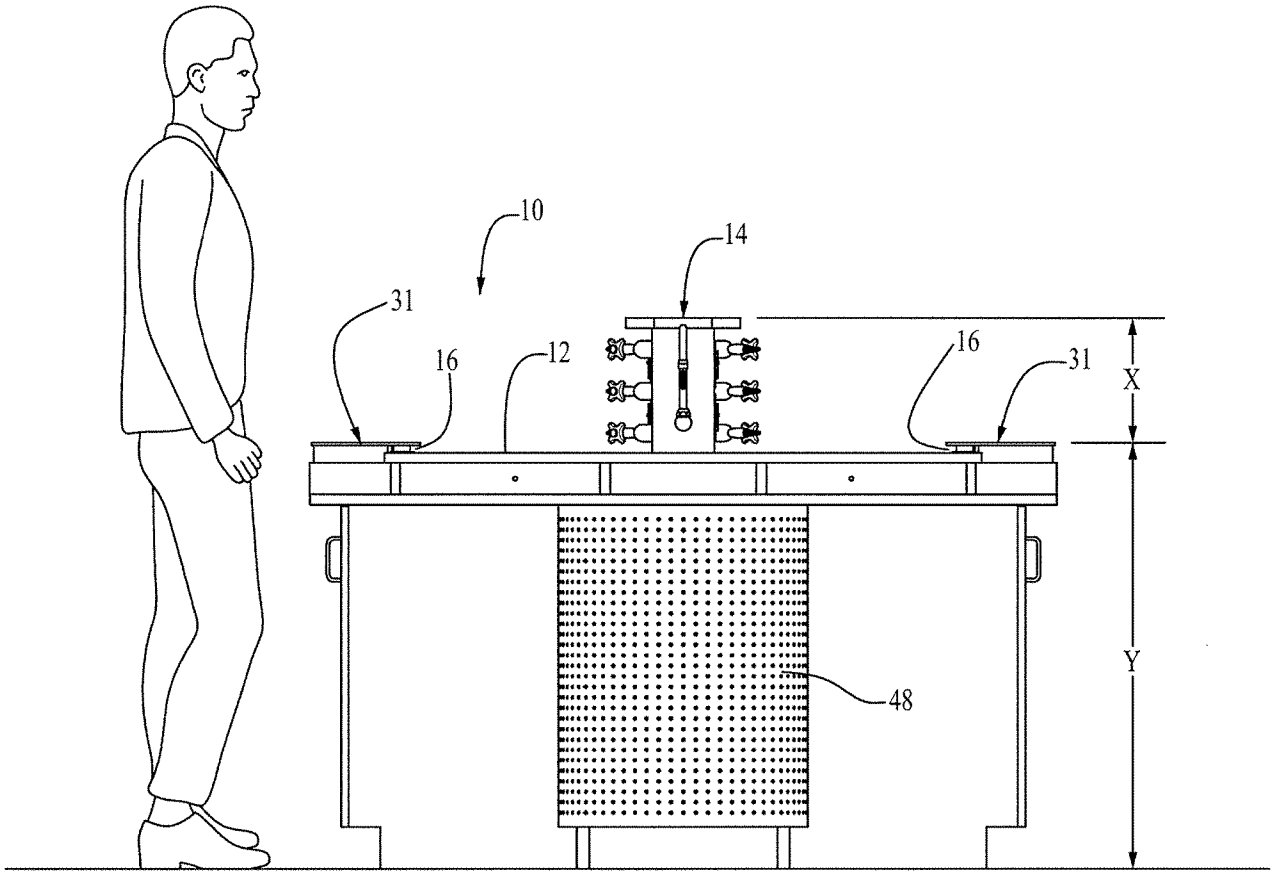
FIG. 8 is an end view of the work station of the present invention showing a student standing at his/her work station.
Figure 9:
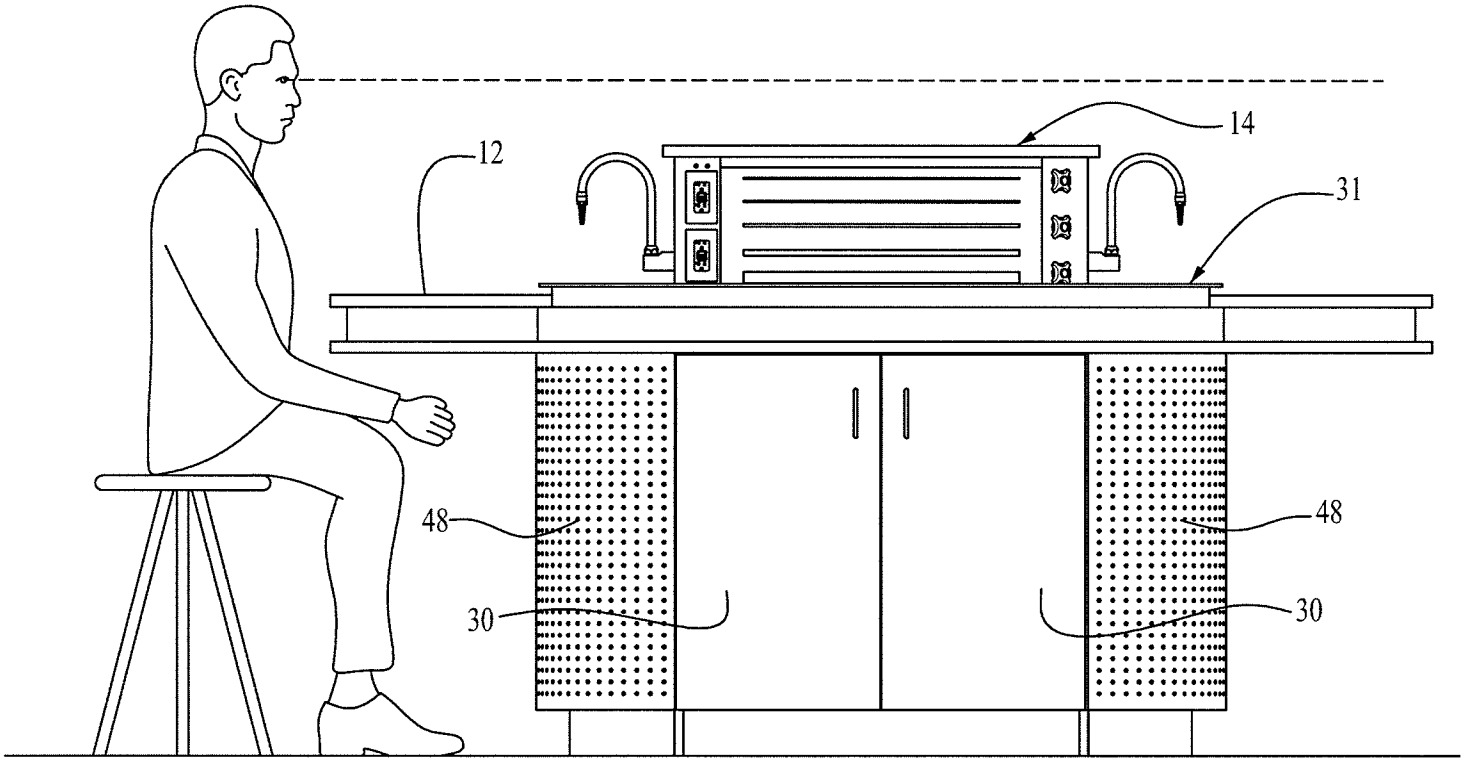
FIG. 9 is an end view of the work station of the present invention showing a student sitting proximate his/her work station.

Referring now in detail to the drawings, the work station 10 of the present invention includes a flat table surface 12, preferably oval in shape to support the interaction between students and instructors, although other configurations can be employed. The table surface 12 is preferably sized so as to accommodate four students defining two pair of lab partners, one pair being positioned on each side of the table surface and having its own work surface 12*a* and 12*b* for conducting experiments. Each of the individuals in each pair also has his/her own writing surface laterally adjacent to their common work surface 12*a* or 12*b* for reading and notetaking. And, whether standing or sitting at or proximate their work or writing surface, each individual has an unobstructed sight line to an instructor (not shown) and to the other students at the work station 10. (See FIGS. 2, 8 and 9.)

Figure 1:
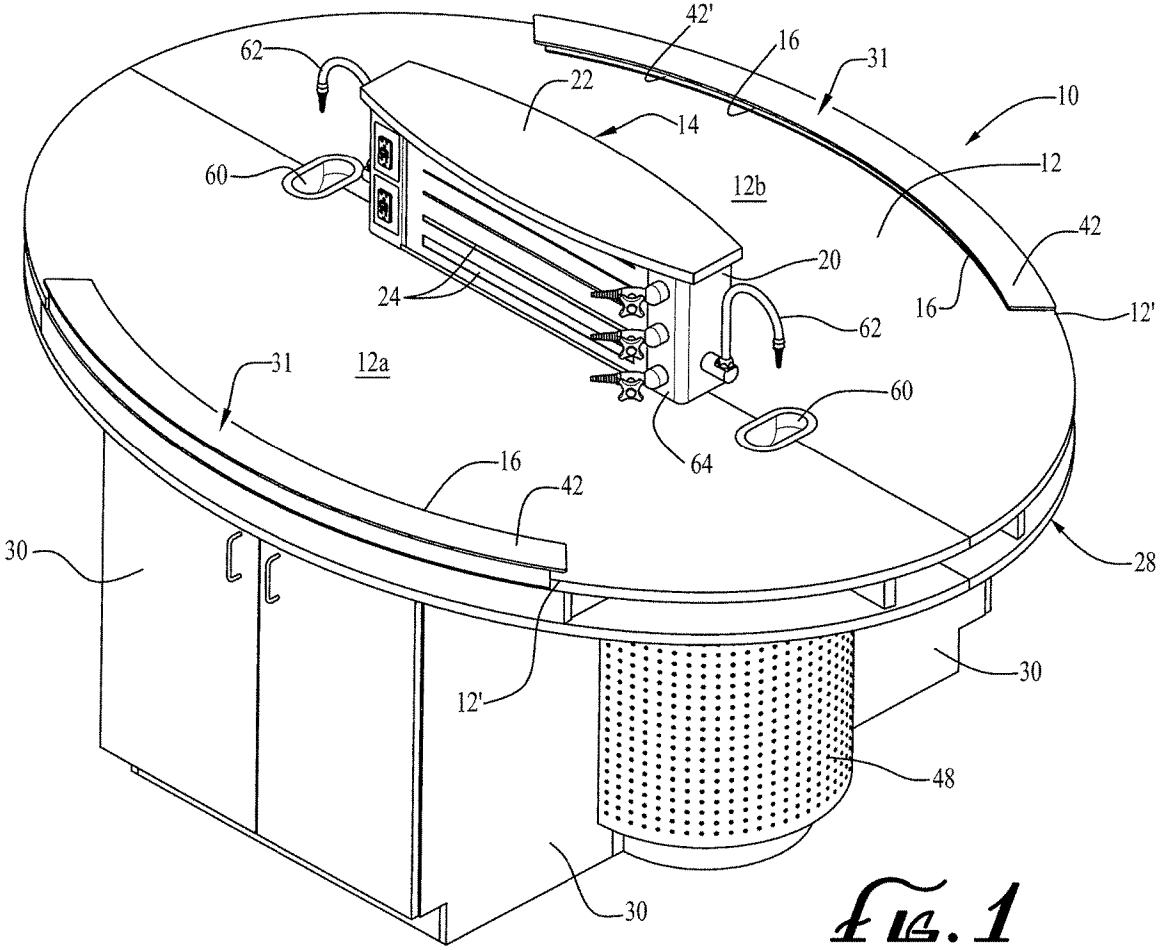
FIG. 1 is a perspective view of a preferred embodiment of the work station of the present invention.

An upstanding and relatively low profile airflow fume extractor 14 is provided in the center of the table surface 12 and a pair of elongated air outlet openings 16 are provided on opposed sides of the work surface substantially adjacent to the table surface (see, e.g. FIG. 1). As will be described, the opposed air outlet openings 16 cooperate with the fume extractor 14 to provide a push-pull airflow system for capturing and exhausting emissions resulting from spills on either of the individual work surfaces 12*a* and 12*b* and fumes emitted from containers used in experiments conducted on the work surfaces, all without obstructing student sight lines to an instructor and other students.

The fume extractor 14 is of a hollow configuration so as to define an interior exhaust plenum 18 within its air impervious end walls 20 and top surface 22 and opposed front and rear open faces which are covered with perforated or slotted grilles 24. The openings in the grilles 24 define a plurality of air inlet openings in the opposed faces of the fume extractor that face the opposed air outlet openings 16 on the sides of the work surface. The exhaust plenum 18 within the fume extractor 14 communicates with an exhaust duct 26 disposed below the plenum 18 that extends downwardly therefrom through the work station 10 and communicates with the exhaust system of the building (not shown) within which the work stations 10 are to be used as illustrated in FIG. 3.

Work station 10 also can include a central support frame 28 for the work surface and a pair of base cabinets 30 secured to frame 28 on opposed sides of the work station. The air outlet openings 16 substantially adjacent to opposed sides of table surface 12 preferably are defined by elongated curvilinear nozzles 31 extending about opposed perimeter portions of the table surface 12. Each nozzle communicates with an air supply plenum 32 via ducts 34.

Figure 3:
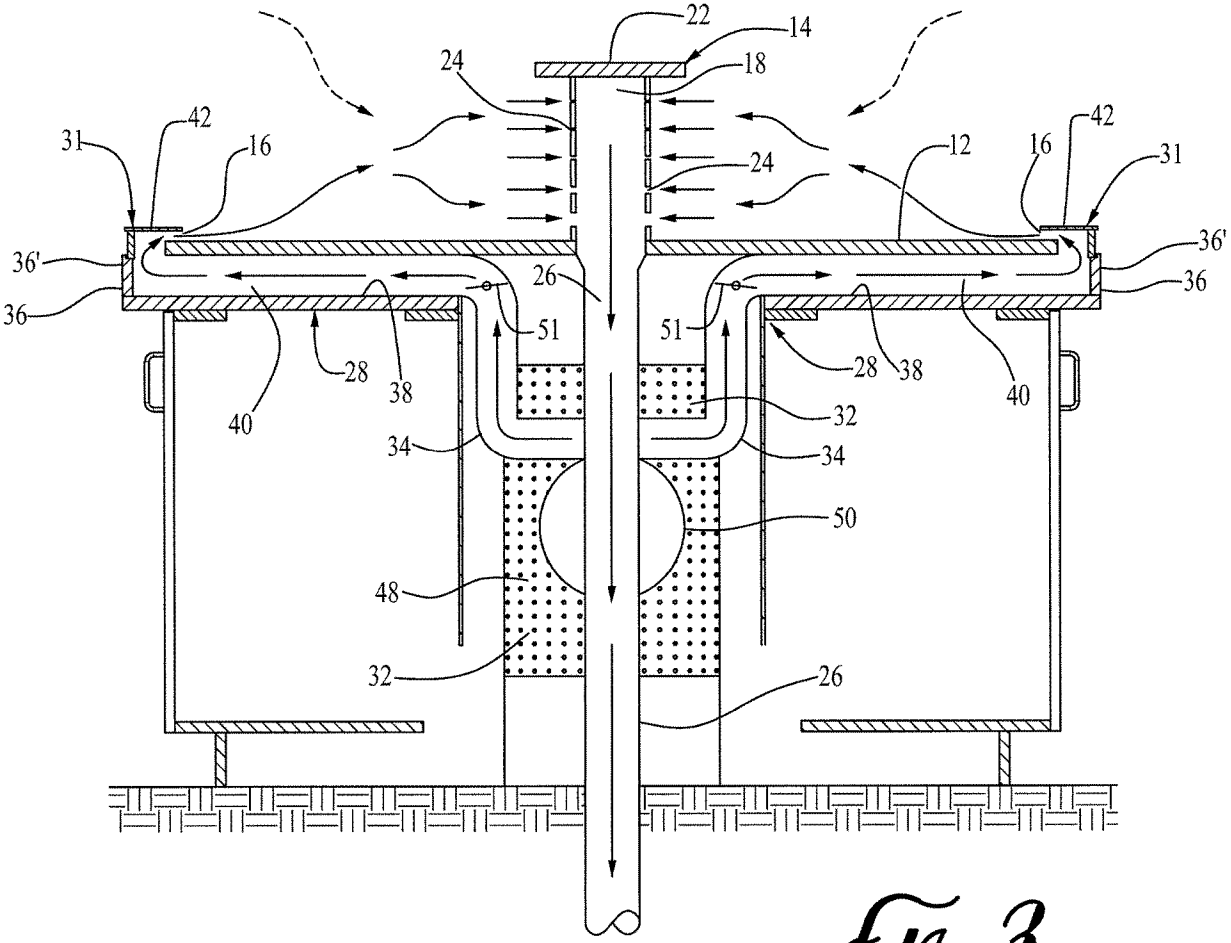
FIG. 3 is a sectional view taken along the line 3-3 of FIG. 2 illustrating in solid arrows both the airflow generated by the work station with the supply airflow to and through the opposed air outlet nozzles toward the fume extractor and the pull air being drawn into and through the fume extractor to the fume exhaust and illustrating in broken arrows the airflow being entrained thereby and drawn into the fume extractor.
Figure 6A:
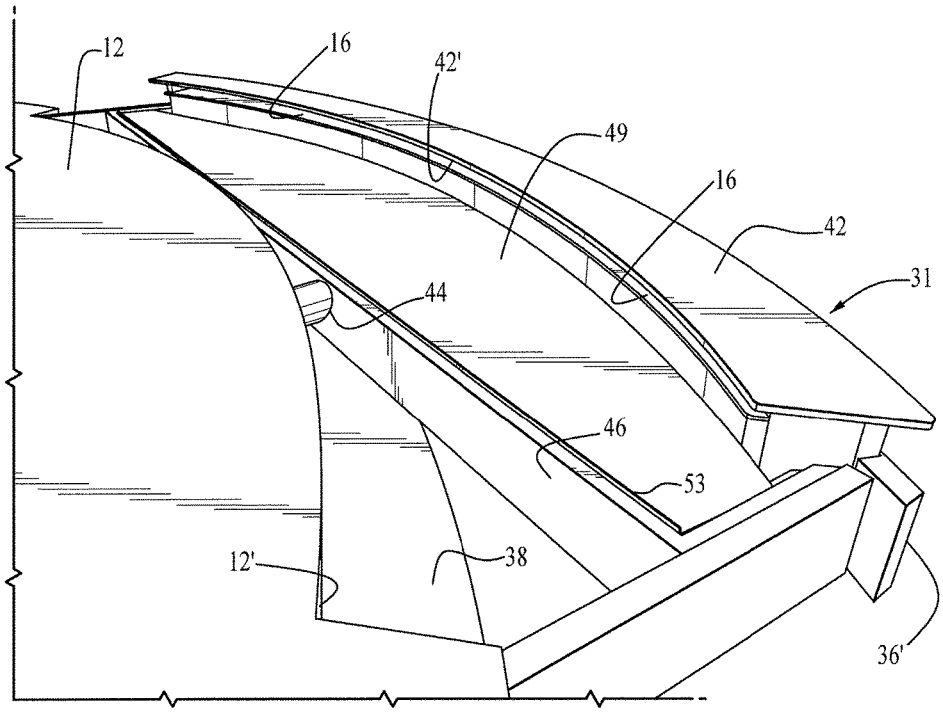
FIG. 6A is an enlarged partial perspective view of the interior of one of the push air plenums with the drawer portion thereof in the extended open position.

In a preferred configuration, an air supply plenum 32 is positioned under the work surface and between the opposed pairs of cabinets 30 as shown in FIG. 3 and a pair of opposed drawers 36 are slidably mounted on the station above the air supply plenum 32 between the underside of table surface 12 and a lower parallel support surface 38. With drawers 36 closed, the interiors of the drawers cooperate with the surrounding structure so as to define a push air plenum 40 that communicates with the air supply plenum 32 through an opening 44 in the inner end wall 46 of each drawer. The front pull edges 36' of drawers 36 can each carry one of the elongated nozzles 31. The details of one embodiment of a drawer 36 and its surrounding structure are shown in FIGS. 6A and 6B.

Figure 6B:
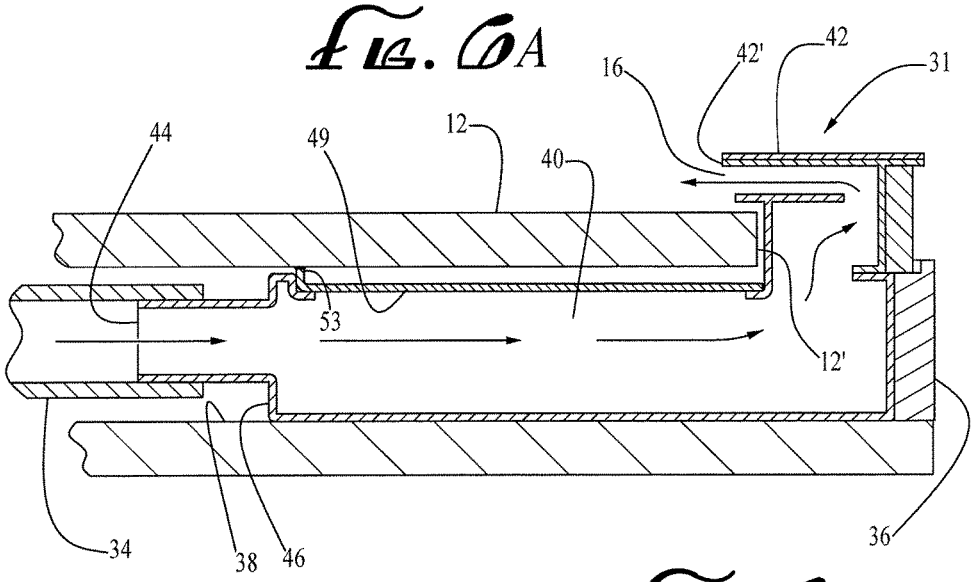
FIG. 6B is an enlarged sectional view of one of the push air plenums and associated air outlet nozzles of the present invention.

As seen in FIG. 6B, the drawers 36 can be provided with an upper plate 49 defining an upstanding sealing flange 53 extending laterally along the inner end portions of the drawer. Sealing flanges 53 preferably are provided with a suitable sealing material at their upper ends for sealing engagement with the underside of table surface 12 while allowing for sliding movement of the drawers. In the event of a liquid spill on either of the work stations 12*a* or 12*b*, any seepage between the outer end portion 12' of the table surface and one of the air outlet nozzles 31 would be contained by plate 49 and sealing flange 53 in the area between plate 49 and the underside of the table surface, preventing contamination of the push air plenums 40 and facilitating cleanup.

The nozzles 31 are preferably formed of a suitable metal material such as stainless steel plate, and include a flange portion 42 that is disposed adjacent to or just slightly above and project inwardly from opposed end portions 12' of the table surface, as seen, for example, in FIG. 1. The inner end faces 42' of the flange portions of the nozzles each define the elongated curvilinear air outlet openings 16 and communicate the atmosphere with the push air plenums 40 in the drawers as shown, for example, in FIGS. 3, 6A and 6B. By utilizing removable drawers in the formation of the push air plenums, access is provided to the interior of the push air system for cleaning in the event of a spill as above described.

Figure 4:
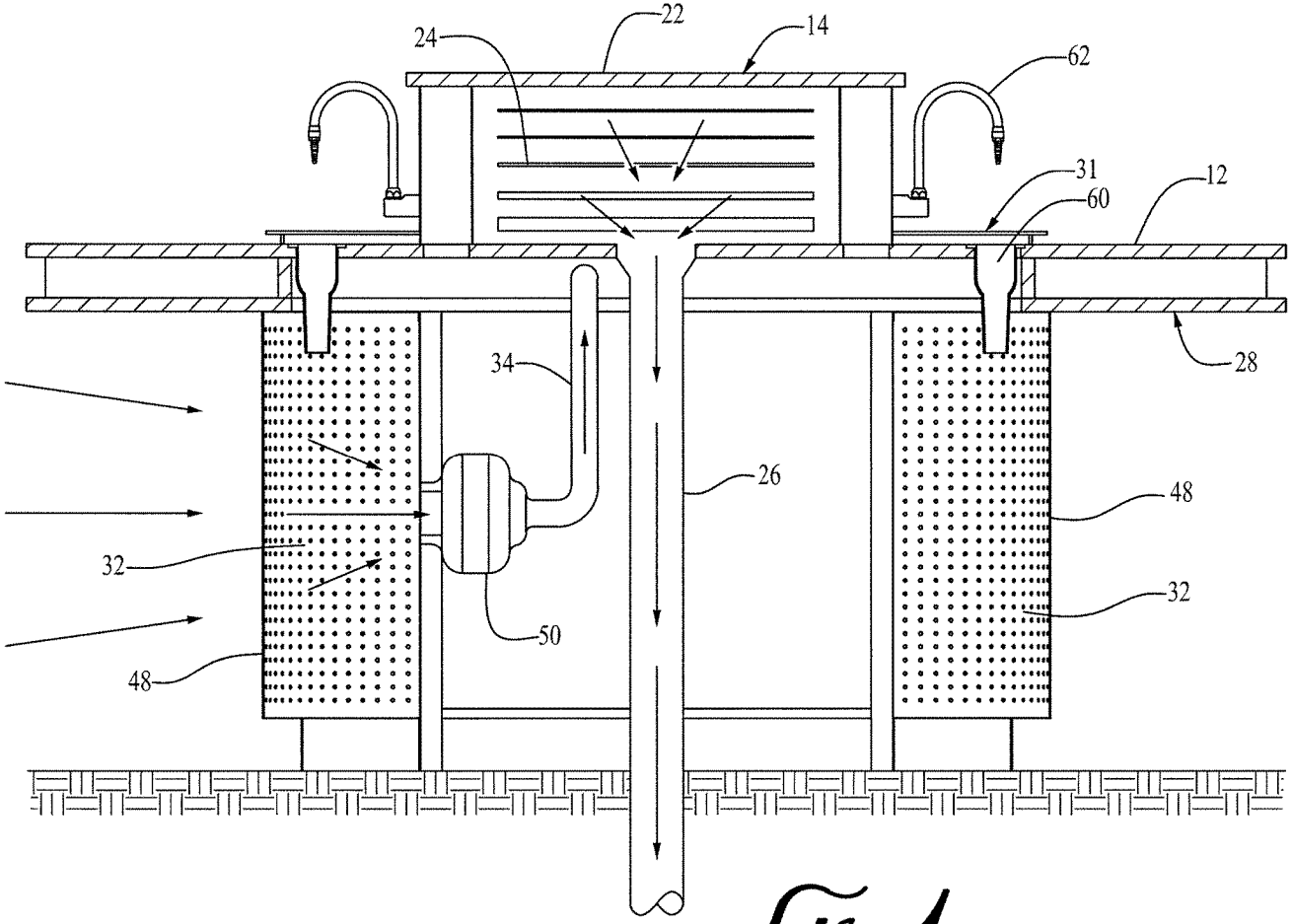
FIG. 4 is a sectional view taken along the line 4-4 of FIG. 2 illustrating in solid arrows both the airflow being drawn into the work station by an interior fan for providing the supply air to the push air plenums and the downward airflow through the fume extractor to the room exhaust system.
Figure 5:
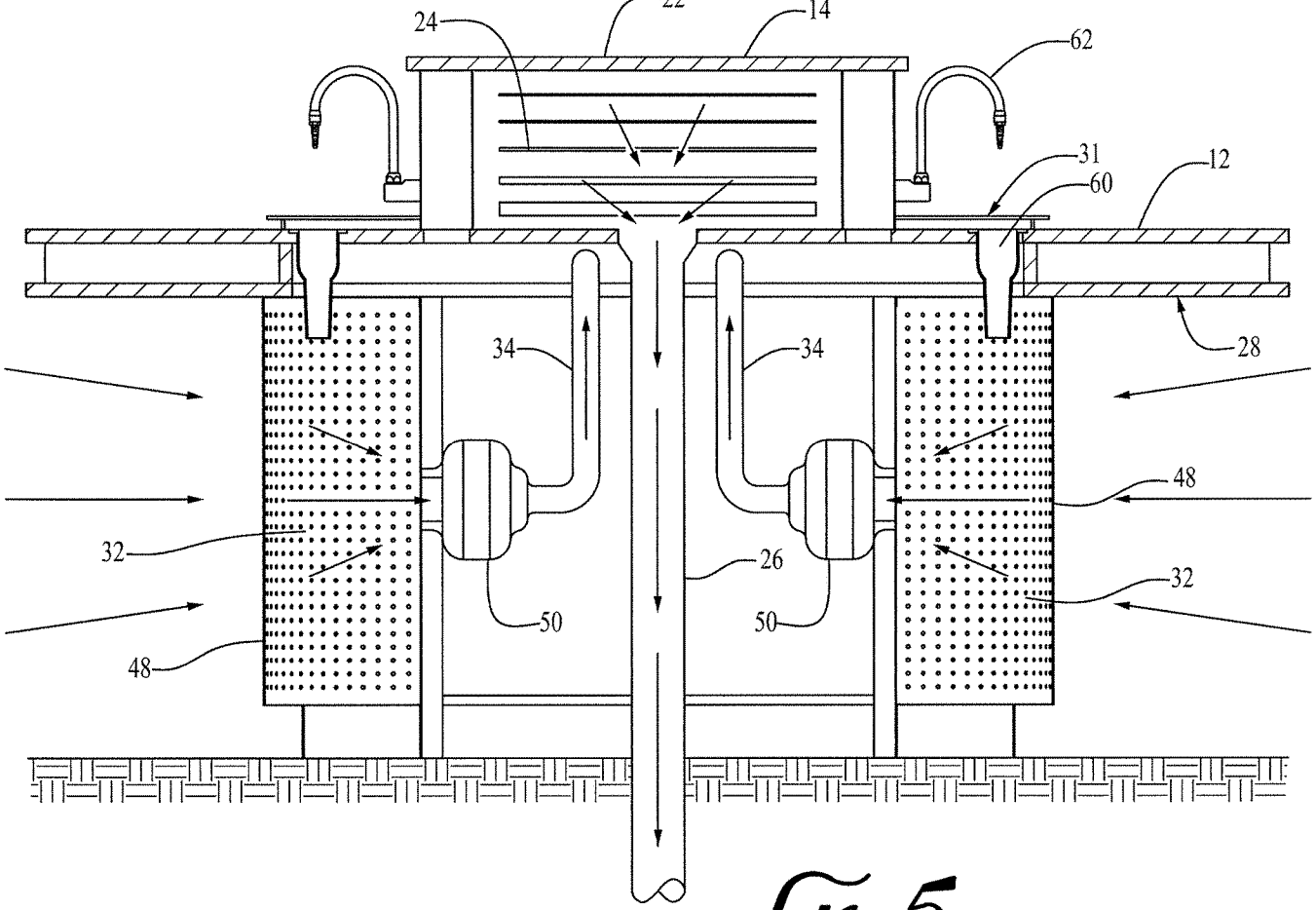
FIG. 5 is a sectional view of an alternate embodiment of a work station of the present invention employing dual fans.

A pair of removable perforated end caps 48 are preferably provided about the outer open ends of the air supply plenums 32 so as to define a plurality of inlet openings for the supply air. One or more inlet fans 50, one being shown in FIG. 4, communicate with the air supply plenum 32 for drawing air into plenum 32 and to the push air plenums 40 in drawers 36 communicating therewith via ducts 34 and openings 44 to generate a positive pressure differential between the interiors of the plenums and the room environment at the air outlet openings 16. See FIGS. 3 and 4. Two such fans (see FIG. 5) and/or a pair of baffles 51 (see FIG. 3) should be provided in the ducting 34 directing the air to the push air plenums 40 to balance the airflow to the plenums 40 and through the opposed air outlet openings 16.

Figure 7:
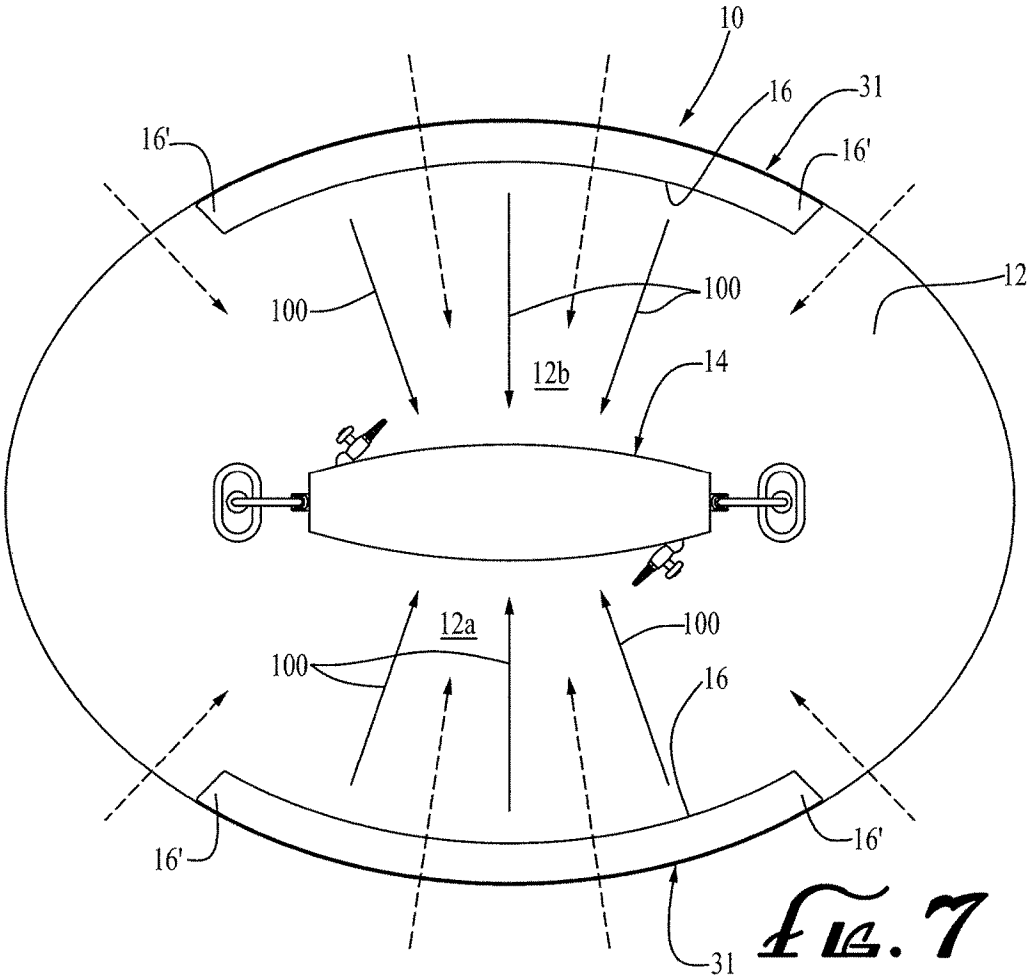
FIG. 7 is a top plan view of a work station embodying the present invention and illustrating the inward airflow from the air outlet openings to the opposed open inlet faces of the fume extractor in solid arrows and the air entrained thereby in dashed arrows.

As illustrated in FIG. 7, the pressure differential created at the elongated air outlet openings 16 creates a wide flow of air that moves over the work surface from the air outlet openings 16 to the fume extractor 14. The inward airflow then is captured by the pressure differential between it and the pressure at the air openings in the fume extractor 14. This difference is due to the negative pressure within the interior of the exhaust plenum 18 in the extractor which causes the airflow from the air outlet openings 16 to be drawn into the opposed sides of the fume extractor through the openings in the grilles 24. This pressure differential coupled with the height of the opposed faces and grilles 24 fume extractor causes the supply airflow from air outlet openings 16 to rise as it approaches the extractor. The inwardly and upwardly expanding airflow also induces additional airflow from the room which is entrained by this airflow and is drawn toward the upper portion of the fume extractor, creating an effective capture and removal of emissions by the airflow both on and above the work surface that result from spills and/or emanate from beakers and other containers thereon. This entrained air is illustrated by dashed arrows in FIGS. 3 and 7. The exhaust flow moves then from the opposed slotted or apertured faces of the fume extractor through the exhaust plenum 18 and into the exhaust duct 26 where it is removed from the room and the building via the building exhaust system.

By way of example, in the above described configuration of the work station 10, which is particularly designed for concurrent use by four students, the oval table surface 12 can have a length of about eight feet and a width of about six feet. The fume extractor, which is positioned in the middle of the work surface, has a height of about twelve inches, a length of about 38 inches and a transverse dimension of about 9.5 inches. The height of the fume extractor 14 is directly related to the height of the contaminant source, e.g., the distance above the table surface 12 of the open upper end of a beaker sitting on a heating element. For the tallest beakers typically used in chemistry classes, that distance was about ten inches. A fume extractor height of twelve inches is thus ideally suitable for such applications and meets the pedagogical requirement of not obstructing the student's lines of sight of other students and the instructor. The radii of curvature of the air outlet openings 16 are about 4.3 feet. The height of the elongated air outlet openings 16 in nozzles 31 is about 0.25 inches and those openings are positioned by the nozzle slightly above the level of the table surface 12, i.e., about 0.0625 inches above surface 12. The "push flow" from each of the air outlet openings 16 is about 15 cfm and the "pull flow" from each side of the fume extractor is about 150 cfm.

Figure 10:
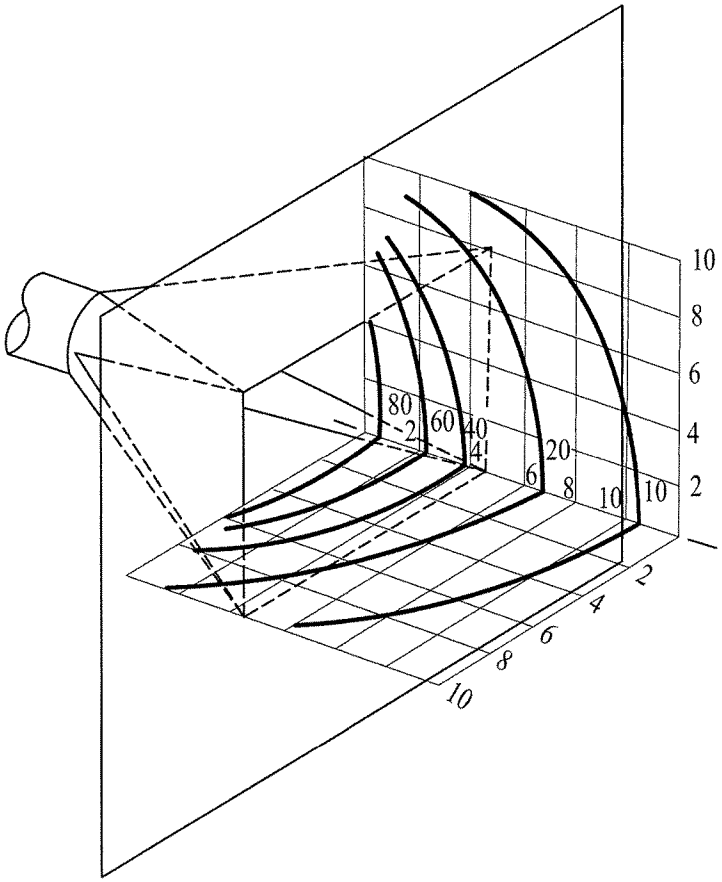
FIG. 10 is an illustration of velocity contour generated by flanged hood under suction taken from *EXHAUST HOODS* by J. M. DallaValle, 1945, p. 15.

This curvilinear shape for the air outlet openings improves the capture efficiency of the fume extractor 14 by directing the "push" flow vectors parallel with the flow vectors generated by the extractor. This condition minimizes turbulence generated by competing flow vectors and enhances cooperation of flow between the push flow and the flow generated by the extractor. For the fume extractor located in the center of the oval air station, the velocity decays from the hood opening as seen in FIG. 10. As a result, the flow vectors generated by the fume extractor are assumed to be normal to the semi elliptical lines shown in FIG. 10. Likewise, the flow vectors created at the push slot at the edge of the table exit the supply opening normal to the curved line of the slot, thereby, mimicking the semi-ellipse of the exhaust hood velocity contours. Thus, the push flow vectors are also normal to exhaust velocity contours, improving "cooperation" between the push and pull flows by significantly reducing vectors that aren't aligned with the direction of flow. On the other hand, a straight slot introduces flow vectors in competing directions to the velocity contours. The "cooperation" achieved by the shape of the work station 10 reduces turbulence and, thus reduces the escape of flow from the hood as compared to flow generated by a straight slot.

By sizing and configuring the fume extractor 14 relative to the table surface 12 and the air outlet openings 16 in combination with the above described flow rates, as above described, a highly efficient airflow is obtained for capturing and containing the fumes both on the surface of the table and at elevations appropriate to capture fumes emitted from beakers, flasks and other containers either resting on the work surface or on heating elements sitting thereon, without obstructing the visual sight lines of the students working on the table to an instructor. Tests have indicated that by adding to above discussed 15 cfm push flow through the air outlet openings 16 in nozzles 31 to the 150 cfm pull flow through each of the opposed open faces of the fume extractor 14, the capture efficiency of the resulting system is about 3.2 times that of a suction or pull only system. In other words, the capture of fugitive emissions increases by a factor of 3.2 and, to obtain the same capture of fugitive emissions with only a fume extractor, the pull flow would have to be increased for each side of the exhaust from 150 cfm to about 750 cfm. Thus, the airflow system of the present invention provides significantly improved capture and exhaustion of fugitive emissions at significantly reduced airflows.

It is to be understood, however, the above-discussed dimensions and airflow rates are by way of example only and could be modified in accordance with the intended usage and size constraints of different applications. An extractor elevation over about 14 inches, however, might interfere with the pedagogical sight line requirements important to the intended application of the present invention. The present invention, however, is not limited to pedagogical applications.

Also, the length and radius of curvature of the air outlet openings 16 depend on the desired size and number of the individual work stations so that the inward airflows emanating therefrom are of sufficient width to cover all of the work surfaces. In addition, the length and radius of curvature of the air outlet openings should be coordinated with the length (L) of the open air inlet faces of the fume extractor such that the air inlet openings 16 define a curvature of sufficient radius and a length of sufficient distance so as to direct opposed airflows across the entire length of the air inlet faces of the fume extractor while avoiding flow outside the lateral edges thereof If the extended ends 16' of air outlet openings are too far apart or the radius of curvature defined by the air inlet openings is too large, the outer regions of the resulting airflows from such air openings may bypass the air inlet faces of the fume extractor in opposed directions and create air turbulence and a decrease in the efficiency of the push-pull airflow system created between the air outlet openings 16 and the air inlet faces 22 of the fume extractor 14.

In addition to the above described features, the work station 10 can also be provided with a plurality of sinks 60 (two being shown), water facets 62, and a service column 64 for gas, air, vacuum valves, electrical outlets, among other features useful for the intended application of the work station. In that regard, while the work station of the present invention was particularly designed for a chemistry teaching laboratory, it also could be utilized in a variety of different applications in which an efficient noxious fume removal system is desired, particularly where unobstructed sight paths for the users also would be beneficial.

While an oval configuration is preferred for the table surface in pedagogical applications, the present invention is also well suited for a circular configuration wherein the elongated curvilinear air outlets could again be conveniently mounted adjacent perimeter portions of the work table and could be positioned on the front pull edge of the plenum drawers as described above in connection with the oval-shaped table surface 12 of work station 10. If desired, rectangular, square and other table surface configurations also could be employed with the present invention. In each case, an elongated air outlet opening would face one of the open air inlet faces of the fume extractor. To avoid a loss of efficiency as a result of air turbulence, the elongated air outlet openings should again be curvilinear. Linear air outlet openings could be employed, albeit with a loss in efficiency due to competing flow vectors generated by the air outlet openings and the extractor.

Various other changes and modifications may be made in carrying out the present invention without departing from the spirit and scope thereof Insofar as said changes and modifications are within the purview of the appended claims, they are to be considered as part of the present invention.

What is claimed is:

1. An open fume capture and exhaust ventilated work station for concurrent use by a plurality of individuals and with an air exhaust system disposed below said station, each such station providing unobstructed sight lines for the individuals working at the station of any other individuals working at said station, said work station comprising:

a flat upper table surface defining a plurality of individual work surfaces thereon;

a hollow fume extractor extending upwardly from a middle portion of said table surface to a distance no more than 14 inches so as not to obstruct said sight lines and wherein said extractor defines opposed upstanding air inlet faces and communicates said faces with an air exhaust system below said work station thereby creating a pressure drop within said extractor to draw air inwardly through said opposed inlet faces thereof;

a pair of opposed laterally elongated air outlet nozzles disposed substantially adjacent to said table surface on opposed sides thereof for directing opposed airflows along said work surfaces toward said opposed air inlet faces of said extractor, said airflows expanding upwardly upon passing through said outlet nozzles and being drawn inwardly and at an upward inclination over said work surfaces by and into said extractor through said air inlet faces thereon and exhausted therefrom by said exhaust system whereby emissions from spills or experiments on said individual work surfaces are effectively captured by said airflows and removed;

at least one air fan disposed below said table surface for generating said airflows through said laterally elongated air outlet nozzles to said air inlet faces on said extractor;

a pair of opposed drawers disposed below said upper table surface so as to be movable between closed and open positions, in said closed position said drawers each comprise an air outlet plenum and in an open position provide access to interior portions of said work station;

a pair of air conduits, one of said air conduits communicating said at least one air fan with one said air outlet plenums through an opening in an inner portion of one of said drawers and the other of said air conduits communicating said at least one air fan with the other of said air outlet plenums through an opening in an inner portion of the other of said drawers; and wherein outer portions of said drawers define air passageways communicating said air outlet plenums with said air outlet nozzles thereby communicating said at least one fan with said air outlet nozzles through said plenums whereby said airflows generated by said at least one fan are directed to the air conduits and through said plenums and said nozzles and along said work surfaces toward said opposed faces of said extractors when the drawers are in the closed position.

2. The work station of claim 1 wherein said laterally elongated air outlet nozzles are curvilinear and define a curvature of sufficient radius and a length of sufficient distance such that the outer regions of said opposing airflows generated therethrough are captured by the extended end portions of said opposed air inlet faces of said fume extractor so as to avoid air turbulence created by any airflow from said air outlet nozzles bypassing said air inlet faces.

3. The work station of claim 1 wherein said at least one fan generates an airflow through each of said opposed air outlet nozzles of 15 cfm and said fume extractor draws air inwardly through each of said opposed inlet faces thereof at a rate of 150 cfm.

4. An open fume capture and exhaust ventilated work station for concurrent use by a plurality of laboratory students in a classroom having a plurality of such work stations therein and with an air exhaust system disposed below said stations, each such station providing unobstructed sight lines for students working at said station of any other students working at said station and of a classroom instructor, said work station comprising:

a flat upper table surface defining a plurality of individual student work surfaces thereon;

a hollow fume extractor extending upwardly from a middle portion of said table surface to an elevation below said student sight lines whereby said sight lines are not obstructed by said extractor and wherein said extractor defines opposed upstanding air inlet faces and communicates said faces with an air exhaust system below said work station thereby creating a pressure drop within said extractor to draw air inwardly through said opposed inlet faces thereof;

a pair of opposed laterally elongated air outlet nozzles disposed substantially adjacent to said table surface on opposed sides thereof for directing opposed airflows along said work surfaces toward said opposed air inlet faces of said extractor, said airflows expanding upwardly upon passing through said outlet nozzles and being drawn inwardly and at an upward inclination over said work surfaces by and into said extractor through said air inlet faces thereon and exhausted therefrom by said exhaust system whereby emissions from spills or experiments on said individual work surfaces are effectively captured by said airflows and removed;

at least one air fan disposed below said table surface for generating said airflows through said air outlet nozzles to said air inlet faces on said extractor;

a pair of opposed drawers disposed below said upper table surface so as to be movable between closed and open positions, in said closed position said drawers each comprise an air outlet plenum and in an open position provide access to interior portions of said work station;

a pair of air conduits, one of said air conduits communicating said at least one air fan with one said air outlet plenums through an opening in an inner portion of one of said drawers and the other of said air conduits communicating said at least one air fan with the other of said air outlet plenums through an opening in an inner portion of the other of said drawers; and wherein outer portions of said drawers define air passageways communicating said air outlet plenums with said air outlet nozzles thereby communicating said at least one fan with said air outlet nozzles through said plenums whereby said airflows generated by said at least one fan are directed to the air conduits and through said plenums and said nozzles and along said work surfaces toward said opposed faces of said extractors when the drawers are in the closed position.

5. The work station of claim 4 wherein said laterally elongated nozzles are curvilinear and define a curvature of sufficient radius and a length of sufficient distance such that the outer regions of said opposing airflows generated therethrough are captured by the extended end portions of said opposed air inlet faces of said fume extractor so as to avoid air turbulence created by any airflow from air outlet nozzles bypassing said air inlet faces.

6. The work station of claim 4 wherein said fan generates an airflow through each of said opposed air outlet nozzles of 15 cfm and said extractor draws air inwardly through and of said opposed inlet faces thereof at a rate of 150 cfm.

7. The work station of claim 4 wherein two fans are disposed below said table surface generating said airflows through said laterally elongated air outlet nozzles to said air inlet faces on said extractor, each of said fans communicating with one of said air outlet plenums and with one of said air outlet nozzles through one of said plenums.

8. An open fume capture and exhaust ventilated work station for concurrent use by a plurality of laboratory students in a classroom having a plurality of such work stations therein and with an air exhaust system disposed below said stations, each such station providing unobstructed sight lines for students working at said station of any other students working at said station and of a classroom instructor, said work station comprising:

a flat upper table surface defining a plurality of individual student work surfaces thereon;

a hollow fume extractor extending upwardly from a middle portion of said table surface to an elevation below said student sight lines whereby said sight lines are not obstructed by said extractor and wherein said extractor defines opposed upstanding air inlet faces and communicates said faces with an air exhaust system below said work station thereby creating a pressure drop within said extractor to draw air inwardly through said opposed inlet faces thereof;

a pair of opposed laterally elongated air outlet nozzles disposed substantially adjacent to said table surface on opposed sides thereof for directing opposed airflows along said work surfaces toward said opposed air inlet faces of said extractor, said airflows expanding upwardly upon passing through said outlet nozzles and being drawn inwardly and at an upward inclination over said work surfaces by and into said extractor through said air inlet faces thereon and exhausted therefrom by said exhaust system whereby said opposed air outlet nozzles and said fume extractor cooperate to capture and remove emissions from spills or experiments on said individual work surfaces; and at least one air fan disposed below said table surface for generating said airflows through said laterally elongated air outlet nozzles to said air inlet faces on said extractor;

a pair of opposed drawers disposed below said upper table surface so as to be movable between closed and open positions, in said closed position said drawers each comprise an air outlet plenum and in an open position provide access to interior portions of said work station;

a pair of air conduits, one of said air conduits communicating said at least one air fan with one said air outlet plenums through an opening in an inner portion of one of said drawers and the other of said air conduits communicating said at least one air fan with the other of said air outlet plenums through an opening in an inner portion of the other of said drawers; and wherein outer portions of said drawers define air passageways communicating said air outlet plenums with said air outlet nozzles thereby communicating said at least one fan with said air outlet nozzles through said plenums whereby said airflows generated by said at least one fan are directed to the air conduits and through said plenums and said nozzles and along said work surfaces toward said opposed faces of said extractors when the drawers are in the closed position.

9. The work station of claim 8 wherein said laterally elongated air outlet air outlet nozzles are curvilinear.

10. The work station of claim 8 wherein said laterally elongated nozzles are curvilinear and define a curvature of sufficient radius and a length of sufficient distance such that the outer regions of said opposing airflows generated therethrough are captured by the extended end portions of said opposed air inlet faces of said fume extractor so as to avoid air turbulence created by any airflow from air outlet nozzles bypassing said air inlet faces.

11. The work station of claim 8 wherein said fan generates an airflow through each of said opposed air outlet nozzles of 15 cfm and said extractor draws air inwardly through and of said opposed inlet faces thereof at a rate of 150 cfm.

12. The work station of claim 8 wherein two fans are disposed below said table surface generating said airflows through said laterally elongated air outlet nozzles to said air inlet faces on said extractor, each of said fans communicating with one of said air outlet plenums and with one of said air outlet nozzles through one of said plenums.

* * * * *